US010043436B2

(12) United States Patent
Wang et al.

(10) Patent No.: US 10,043,436 B2
(45) Date of Patent: Aug. 7, 2018

(54) DISPLAY DEVICE

(71) Applicant: InnoLux Corporation, Miao-Li County (TW)

(72) Inventors: Li-Jin Wang, Miao-Li County (TW); Yao-Lien Hsieh, Miao-Li County (TW); Chan-Feng Chiu, Miao-Li County (TW); Chung-Yi Wang, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 93 days.

(21) Appl. No.: 15/184,561

(22) Filed: Jun. 16, 2016

(65) Prior Publication Data

US 2017/0076652 A1 Mar. 16, 2017

(30) Foreign Application Priority Data

Sep. 11, 2015 (CN) ..... 2015 1 0577707

(51) Int. Cl.
*G09G 3/20* (2006.01)

(52) U.S. Cl.
CPC ... *G09G 3/2003* (2013.01); *G09G 2300/0452* (2013.01); *G09G 2310/08* (2013.01); *G09G 2320/0242* (2013.01)

(58) Field of Classification Search
None
See application file for complete search history.

(56) References Cited

U.S. PATENT DOCUMENTS

2003/0067458 A1* 4/2003 Anzai ..... G09G 3/3225 345/204
2012/0044275 A1* 2/2012 Kobayashi ..... G09G 3/20 345/690

* cited by examiner

*Primary Examiner* — Joseph Haley
(74) *Attorney, Agent, or Firm* — McClure, Qualey & Rodack, LLP

(57) ABSTRACT

A display device including a first pixel, a second pixel, and a control unit is provided. The first and second pixels are coupled to a data line. The control unit generates a first original image signal and a second original image signal required by the first and second pixels in a frame time according to an analog image and generates a first output image signal and a second output image signal according to the difference between the first and second original image signals. In the frame time, the control unit sequentially provides the first and second output image signals to the first and second pixels via the data line.

8 Claims, 12 Drawing Sheets

DISPLAY DEVICE

CROSS REFERENCE TO RELATED APPLICATIONS

This Application claims priority of China Patent Application No. 201510577707.3, filed on Sep. 11, 2015, the entirety of which is incorporated by reference herein.

BACKGROUND OF THE INVENTION

Field of the Invention

The invention relates to an electronic device, and more particularly to a display device.

Description of the Related Art

Flat panel displays are widely used because they possess such favorable advantages as having a thin profile, light weigh, and low radiation. Generally, each display comprises various pixels. The color of each pixel can be controlled according to scan lines, which are horizontally extended, and data lines, which are vertically extended. However, the lengths of the data lines of the display increase as the size of the display increases. Therefore, the equivalent impedances of the data lines are increased. When one data line transmits the same data signals to different pixels, the different pixels may display different colors and cause low display quality .

BRIEF SUMMARY OF THE INVENTION

In accordance with an embodiment, a display device comprises a first pixel, a second pixel, and a control unit. The first and second pixels are coupled to a data line. The control unit generates a first original image signal and a second original image signal required by the first and second pixels in a frame time according to an analog image and generates a first output image signal and a second output image signal according to the difference between the first and second original image signals. In the frame time, the control unit sequentially provides the first and second output image signals to the first and second pixels via the data line.

A control method for a display panel device is provided. The display panel comprises a data line, a first pixel, and a second pixel. The first and second pixels are coupled to the data line. An exemplary embodiment of a control method for a display panel is described in the following. A first original image signal and a second original image signal required by the first and second pixels in a frame time are generated according to an analog image. A first output image signal and a second output image signal are generated according to the difference between the first and second original image signals. The first output image signal is first provided to the first pixel and then the second output image signal is provided to the second pixel via the data line in the frame time.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
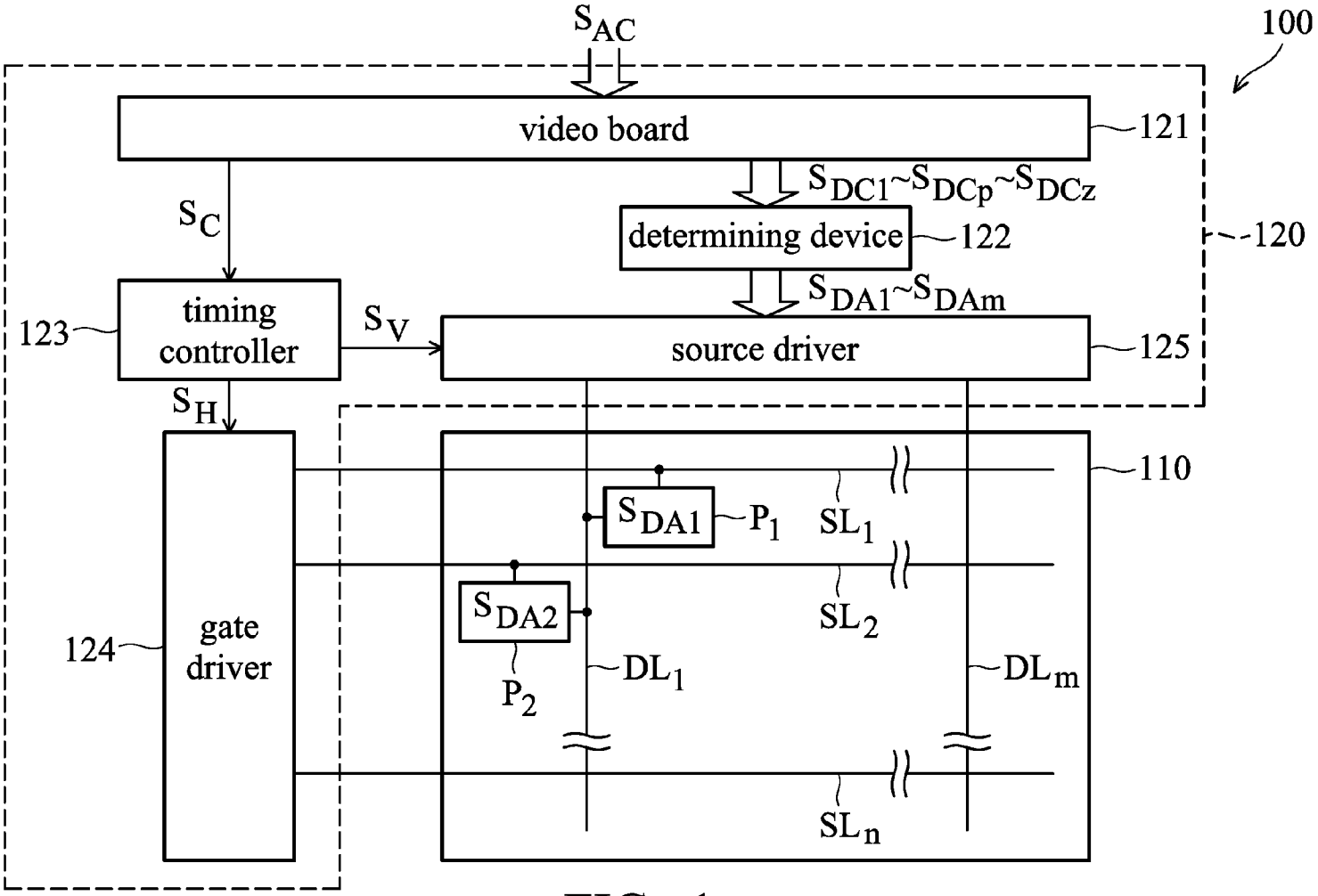
FIG. 1 is a schematic diagram of an exemplary embodiment of a display device, according to various aspects of the present disclosure.

FIG. 1 is a schematic diagram of an exemplary embodiment of a display device, according to various aspects of the present disclosure. As shown in FIG. 1, the display device 100 comprises a display panel 110 and a control unit 120. In the present invention, the kind of display device 100 is not limited. In one embodiment, the display device 100 is a personal digital assistant (PDA), a cellular phone, a digital camera, a television, a global positioning system (GPS), a car display, an avionics display, a digital photo frame, a notebook computer (NB), or a personal computer (PC).

The display panel 110 comprises a plurality of scanlines $SL_1$~$SL_n$, a plurality of data lines $DL_1$~$DL_m$, and a plurality of pixels. Each pixel is coupled to a corresponding scan line and a corresponding data line, receives the data signal transmitting by the corresponding data line according to the scan signal transmitting by the corresponding scan line, and then displays a corresponding color according to the data signal. In a frame time, each scan line is activated one time so that each pixel receives the corresponding data signal. In the next frame time, each scan line is activated again and each pixel receives a new data signal. For brevity, FIG. 1 only shows the pixels $P_1$ and $P_2$, however, without limitation to the present invention.

In the present invention, the arrangement of the pixels is not limited. In this embodiment, the pixels $P_1$ and $P_2$ are coupled to the same data line $DL_1$ and coupled to different scan lines, such as $SL_1$ and $SL_2$, but the disclosure is not limited thereto. In other embodiments, the pixels $P_1$ and $P_2$ may be coupled to different data lines, or they may be coupled to the same scan line. In some embodiments, the scan line coupled to the first pixel is not the neighbor of the scan line coupled to the second pixel. In other words, at least one scan line is disposed between one scan line coupled to the first pixel and another scan line coupled to the second pixel.

In FIG. 1, the pixel $P_1$ is disposed on the right side of the data line $DL_1$ and the pixel $P_2$ is disposed on the left side of the data line $DL_1$, but the disclosure is not limited thereto. In other embodiments, both of the pixels $P_1$ and $P_2$ may be disposed on the right or left side of the data line $DL_1$. In addition, the present invention does not limit the colors displayed by the pixels $P_1$ and $P_2$. The color displayed by the pixel $P_1$ may be the same as or different from the color displayed by the pixel $P_2$.

The control unit 120 generates a plurality of original image signals $S_{DC1}$~$S_{DCz}$ according to an analog image $S_{AC}$, wherein the original image signals $S_{DC1}$~$S_{DCz}$ are the data signals required by all of the pixels of the display panel 110 in a frame time. In one embodiment, the original image signals $S_{DC1}$~$S_{DCz}$, are gray levels. To compensate for the delay effect caused by the equivalent impedances of the data lines, the control unit 120 adjusts the original image signals $S_{DC1}$~$S_{DCz}$ to generate output image signals $S_{DA1}$~$S_{DAm}$.

For example, the control unit 120 generates the output image signals $S_{DA1}$ and $S_{DA2}$ according to the difference between the original image signals $S_{DC1}$ and $S_{DCp}$ among the original image signals $S_{DC1}$~$S_{DCz}$, wherein the original image signal $S_{DC1}$ is a gray level for the pixel $P_1$ and the original image signal $S_{DCp}$ is a gray level for the pixel $P_2$ in a frame time. Then, the control unit 120 sequentially provides the output image signal $S_{DA1}$ to the pixel $P_1$ and the output image signal $S_{DA2}$ to the pixel $P_2$ via the data line $DL_1$ in the frame time. In other words, the time when the pixel $P_1$ receives the output image signal $S_{DA1}$ is earlier than the time when the pixel $P_2$ receives the output image signal $S_{DA2}$. In one embodiment, the output image signals $S_{DA1}$ and $S_{DA2}$ are gray levels.

The invention does not limit how the control unit 120 utilizes the difference between the original image signals $S_{DC1}$ and $S_{DCp}$ to generate the output image signals $S_{DA1}$ and $S_{DA2}$. In one embodiment, when the difference between the original image signals $S_{DC1}$ and $S_{DCp}$ is higher than a pre-determined value, the control unit 120 adjusts at least one of the original image signals $S_{DC1}$ and $S_{DCp}$ to generate the output image signals $S_{DA1}$ and $S_{DA2}$. In one embodiment, the control unit 120 only adjusts the original image signal $S_{DC1}$ to generate an adjusted result, serves the adjusted result as the output image signal $S_{DA1}$, and serves the original image signal $S_{DCp}$ as the output image signal $S_{DA2}$. In another embodiment, the control unit 120 adjusts the original image signals $S_{DC1}$ and $S_{DCp}$ and serves the adjusted results as the output image signals $S_{DA1}$ and $S_{DA2}$.

However, when the difference between the original image signals $S_{DC1}$ and $S_{DCp}$ is not higher than the pre-determined value, the control unit 120 does not adjust the original image signals $S_{DC1}$ and $S_{DCp}$ and directly serves the original image signals $S_{DC1}$ and $S_{DCp}$ as the output image signals $S_{DA1}$ and $S_{DA2}$. In other embodiments, the control unit 120 suitably adjusts at least one of the original image signals $S_{DC1}$ and $S_{DCp}$ according to the difference between the original image signals $S_{DC1}$ and $S_{DCp}$ and utilizes the same data line to sequentially output the adjusted results to the pixels $P_1$ and $P_2$.

Figure 2A:
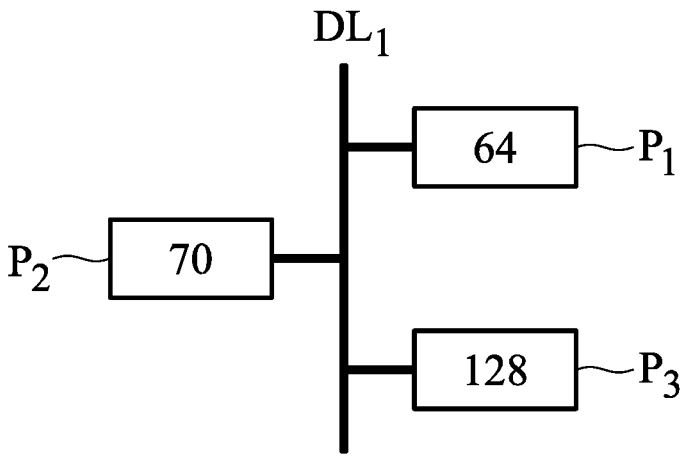
FIGS. 2A and 2B show relationships between the original image signals and the output image signals, according to various aspects of the present disclosure.
Figure 2B:
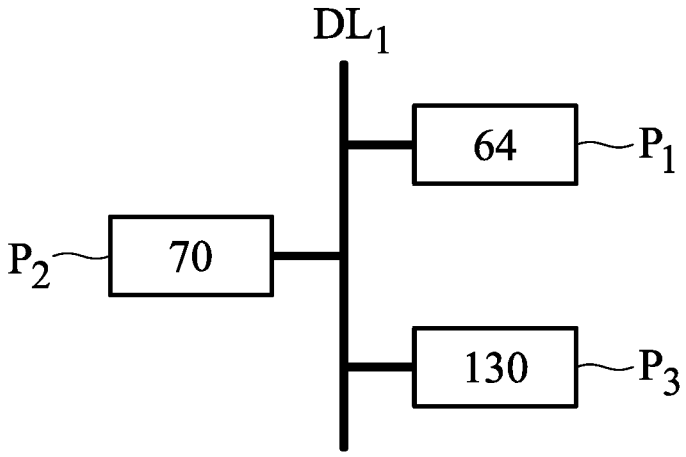

FIGS. 2A and 2B show relationships between the original image signals and the output image signals, according to various aspects of the present disclosure. Refer to FIG. 2A (shown the original image signals), assume that the original image signals required by the pixels $P_1$~$P_3$ are the gray levels 64, 70, and 128, respectively. In one embodiment, the control unit 120 judges the difference between the gray levels for the pixels $P_1$ and $P_2$ first. Since the difference between the gray levels for the pixels $P_1$ and $P_2$ is not large, the control unit 120 does not adjust the gray levels for the pixels $P_1$ and $P_2$ and provides the output image signals as the same as the original image signals. Therefore, the gray levels actually received by the pixels $P_1$ and $P_2$ are 64 and 70 (as shown as the FIG. 2B).

However, the difference between the gray levels for the pixels $P_2$ and $P_3$ is large such that the control unit 120 adjusts the gray level for the pixel $P_3$. In this case, the gray level for each pixel (e.g. $P_3$) is changed according to the gray level for the previous pixel (e.g. $P_2$), but the disclosure is not limited. In other embodiments, the gray level for eachpixel (e.g. $P_2$) is also changed according to the gray level for the next pixel (e.g. $P_3$).

Figure 3A:
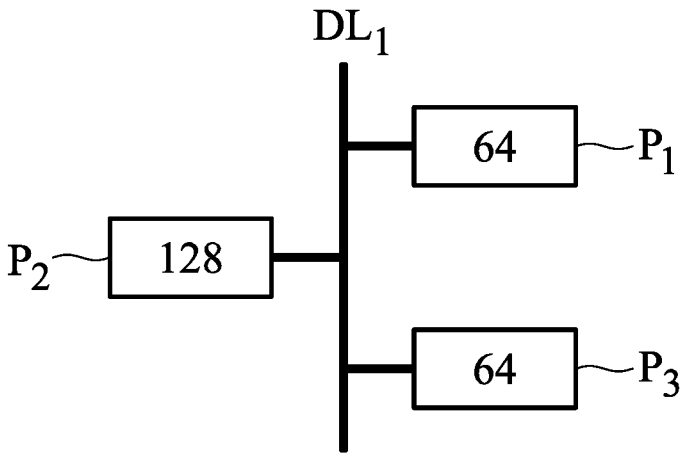
FIGS. 3A and 3B show relationships between the original image signals and the output image signals, according to various aspects of the present disclosure.
Figure 3B:
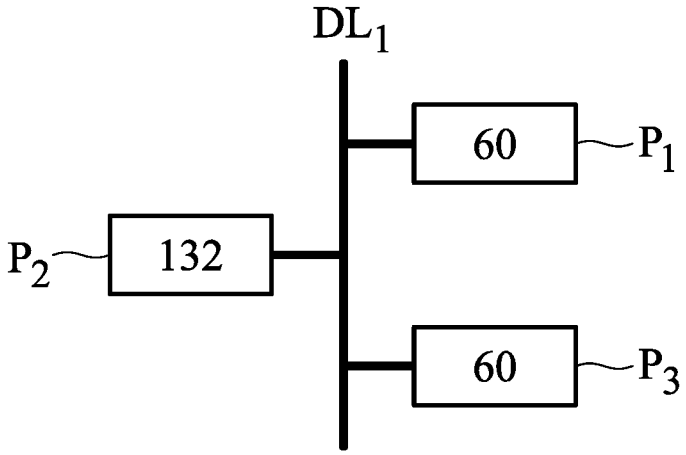

For example, refer to FIG. 3A (shows the original image signals), assume that the original image signals for the pixels $P_1$~$P_3$ are the gray levels 64, 128, and 64, respectively. The gray level 64 for the pixel $P_1$ is less than the gray level 128 for the pixel $P_2$. Therefore, the control unit 120 increases the gray level for the pixel $P_2$ from 128 to 132. As shown in FIG. 3B (shows the output image signals), the output image signal actually received by the pixel $P_2$ is the gray level 132. Furthermore, since the original gray level of the pixel $P_2$ is 128 higher than the original gray levels (64) of the pixels $P_1$ and $P_3$, the control unit 120 decreases the gray levels for the pixels $P_1$ and $P_3$ from 64 to 60. As shown in FIG. 3B, the output image signals actually received by the pixels $P_1$ and $P_3$ are the gray level 60.

Figure 4A:
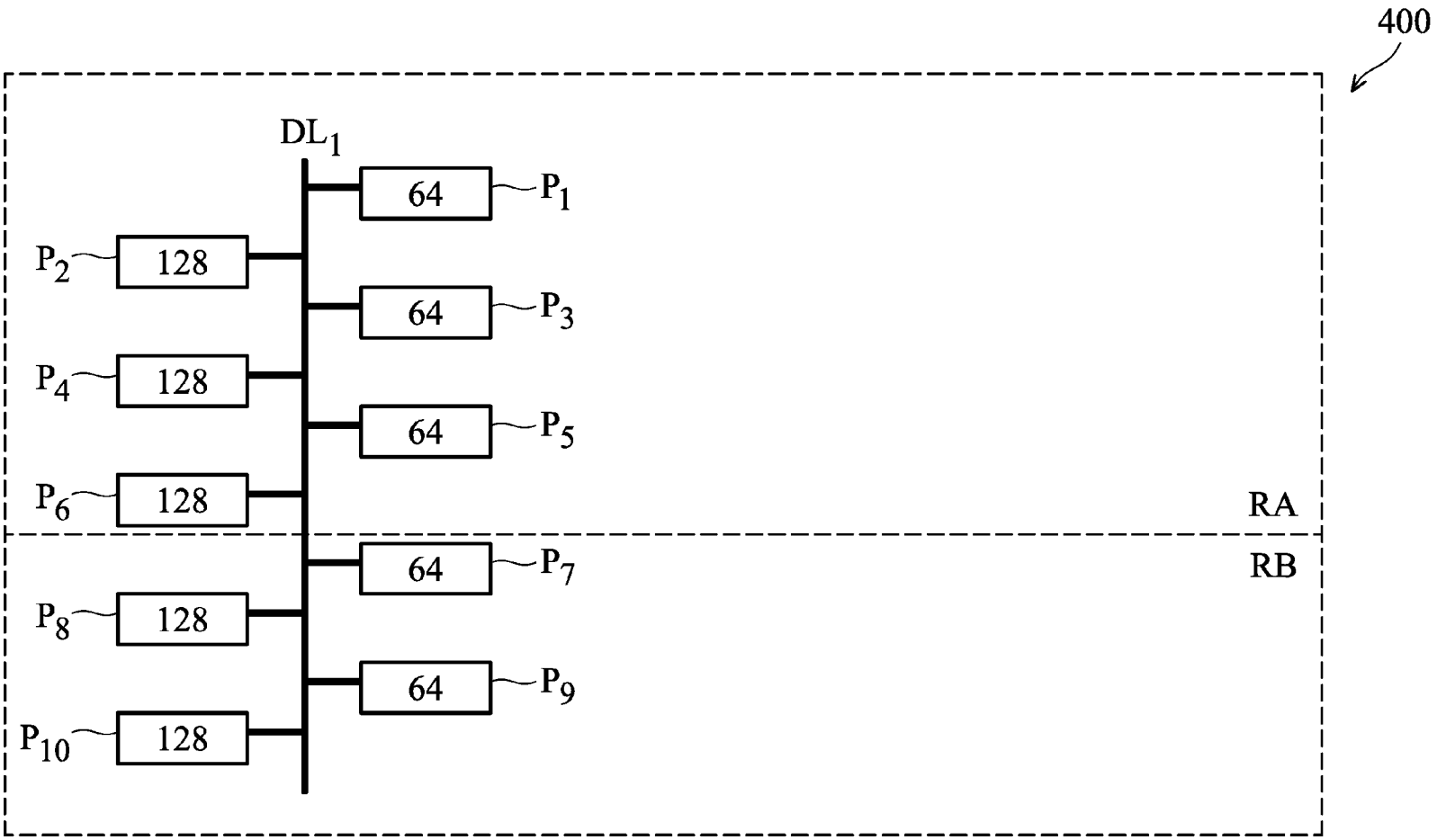
FIGS. 4A and 4B show relationships between the original image signals and the output image signals, according to various aspects of the present disclosure.
Figure 4B:
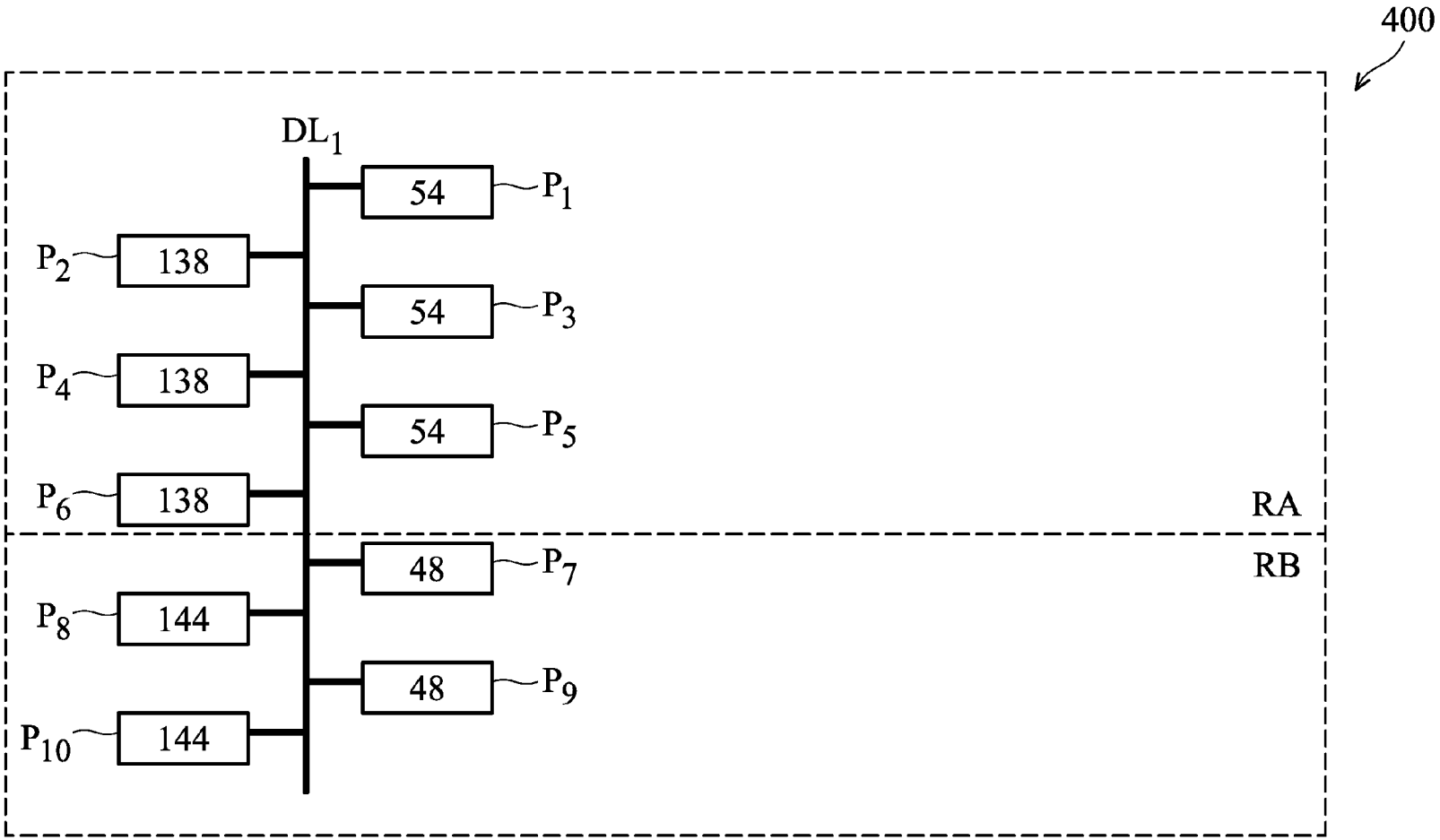

In the present invention, the adjusted range of the gray level is not limited. In this embodiment, the difference of the original gray levels between the pixels $P_1$ and $P_2$ is the same as the difference of the original gray levels between the pixels $P_2$ and $P_3$. Therefore, the adjusted range of the gray level for the pixel $P_2$ is the same as the adjusted range of the gray level for the pixel $P_3$, however, without limitation to the present invention. In some embodiments, the adjusted range of the gray level relates to the position of the pixel on a display panel. FIGS. 4A and 4B show the adjusted ranges of the gray levels, according to various aspects of the present disclosure. As shown in FIGS. 4A (shows the original image signals) and 4B (shows the output image signals), the display panel 400 is divided into regions RA and RB, but the disclosure is not limited thereto. In some embodiments, the display panel 400 is divided into three or more regions. In this embodiment, the region RA is near to an external control unit and the region RB is far from the external control unit.

Assume that the original gray levels for the pixels $P_1$, $P_3$, $P_5$, $P_7$, and $P_9$ are 64, and the original gray levels for the pixels $P_2$, $P_4$, $P_6$, $P_8$, and $P_{10}$ are 128. The difference of the original gray levels between the pixels $P_1$ and $P_2$ is higher than a pre-determined value (e.g. 8 or 24), the output gray level for the pixel $P_2$ is increased from 128 to 138. Refer to FIG. 4B, the output image signal actually received by the pixel $P_2$ is the gray level 138. The adjustment methods for the pixels $P_4$ and $P_6$ are the same as the adjustment method for the pixels $P_2$, so the description of the adjustment methods for the pixels $P_4$ and $P_6$ are omitted.

Refer to FIG. 4A, the original gray level (64) for the pixel $P_3$ is lower than the original gray levels (128) for the pixel $P_2$, the output gray level for the pixels $P_3$ are decreased from 64 to 54, as shown in FIG. 4B. The adjustment method for the pixel $P_5$ is the same as the adjustment method for the pixels $P_3$, the description of the adjustment method for the pixel $P_5$ is omitted.

Then, refer to FIG. 4A, assume that the pixels $P_1$~$P_6$ in the region RA belong to a first group, and the pixels $P_7$~$_{10}$ in the region RB belong to a second group. The first group is near to the external control unit and the second group is far from the external control unit. The original gray level for the pixel $P_1$ is the same as the original gray level for the pixel $P_7$. The original gray level for the pixel $P_2$ is the same as the original gray level for the pixel $P_8$. In other words, the difference of the original gray levels between the pixels $P_1$ and $P_2$ is the same as the difference of the original gray levels between the pixels $P_7$ and $P_8$, but the output gray level for the pixel $P_7$ is decreased from 64 to 48. The output gray level for the pixel $P_7$ is different from the output gray level for the pixel $P_1$. Moreover, the output gray level for the pixel $P_8$ is increased from 128 to 144 and is different from the output gray level for the pixel $P_2$. As shown in FIG. 4B, the output image signal actually received by the pixel $P_7$ is the gray 48, and the output image signal actually received by the pixel $P_8$ is the gray 144. In some embodiments, the adjusted range of the gray level for one pixel is increased as the distance between the one pixel and the control unit increases.

In some embodiments, the pixels $P_1$~$P_8$ sequentially receive the data signals. Assume that the pixels $P_1$, $P_2$, $P_7$, and $P_8$ are referred to as a first pixel, a second pixel, a third pixel and a fourth pixel. As shown in FIG. 4A, the original gray level (128) for the second pixel ($P_2$) is the same as the original gray level (128) for the fourth pixel ($P_8$), and the difference between the original gray levels for the first pixel ($P_1$) and the second pixel ($P_2$) is the same as the difference between the original gray levels for the third pixel ($P_7$) and the fourth pixel ($P_8$). In this case, the output image signal, which is the gray level 138 and actually received by the second pixel ($P_2$), is different from the output image signal, which is the gray level 144 and actually received by the fourth pixel ($P_8$). In another embodiment, the first pixel ($P_1$) and the third pixel ($P_7$) have the same original gray level (e.g. 64), and the difference between the original gray levels for the second pixel ($P_2$) and the first pixel ($P_1$) is the same as the difference between the original gray levels for the fourth pixel ($P_8$) and the third pixel ($P_8$). Therefore, the gray level (54) of the output image signal actually received by the first pixel ($P_1$) is different from the gray level (48) of the output image signal actually received by the third pixel ($P_7$). In some embodiments, when the first pixel ($P_1$) and the third pixel ($P_7$) have the same original gray level (e.g. 64) and the second pixel ($P_2$) and the fourth pixel ($P_8$) have the same original gray level (e.g. 128), the gray level (138) of the output image signal actually received by the second pixel ($P_2$) is different from the gray level (144) of the output image signal actually received by the fourth pixel ($P_8$).

The invention does not limit how the control unit 120 utilizes the difference between the original gray levels for two pixels to adjust the original gray levels. In one embodiment, the control unit 120 stores a look-up table describing the relationships between the differences of the gray levels and the adjustment ranges of the gray levels. The control unit 120 finds the corresponding adjustment range from the look-up table according to the difference between the original gray levels for the pixels. The control unit 120 adjusts the corresponding original gray levels for the pixels according to the adjustment range with the look-up table and then provides the new gray level to the corresponding pixel. Since the image signal received by each pixel relates to the image signal received by the previous pixel, the distortion effect of the image signal can be improved.

Refer to FIG. 1, the invention does not limit the internal structure of the control unit 120. In one embodiment, the control unit 120 comprises a video board 121, a determining device 122, a timing controller (TCON) 123, a gate driver 124 and a source driver 125. The video board 121 is configured to transform the analog image $S_{AC}$ to original image signals $S_{DC1}$~$S_{DCz}$ and generate a control signal $S_C$. The invention does not limit the internal structure of the video board 121. Any circuit structure can serve as the video board 121, as long as the circuit structure is capable of transforming an analog image to a digital image.

The determining device 122 generates the output image signals $S_{DA1}$~$S_{DAm}$ according to the original image signals $S_{DC1}$~$S_{DCz}$. For example, the determining device 122 adjusts at least one of the original image signals $S_{DC1}$ and $S_{DCp}$ according to the signal difference between the original image signals $S_{DC1}$ and $S_{DCp}$. In one embodiment, the determining device 122 only adjusts the original image signal $S_{DC1}$ or $S_{DC2}$ to generate an adjusted result and serves the adjusted result as the output image signal $S_{DA1}$ or $S_{DA2}$. In this case, the determining device 122 directly serves the original image signal $S_{DC2}$ or $S_{DC1}$ as the output image signal $S_{DA2}$ or $S_{DA1}$. In other embodiments, the determining device 122 adjusts the original image signals $S_{DC1}$ and $S_{DCp}$. In one embodiment, the determining device 122 is integrated into the video board 121.

The timing controller 123 generates a horizontal synchronization signal $S_H$ and a vertical synchronization signal $S_V$. The gate driver 124 asserts the scan lines $SL_1$~$SL_n$ according to the horizontal synchronization signal $S_H$. The source driver 125 outputs the output image signal $S_{DA1}$ to the pixel $P_1$ and outputs the output image signal $S_{DA2}$ to the pixel $P_2$ according to the vertical synchronization signal $S_V$. In one embodiment, the determining device 122 is integrated into the source driver.

Figure 5A:
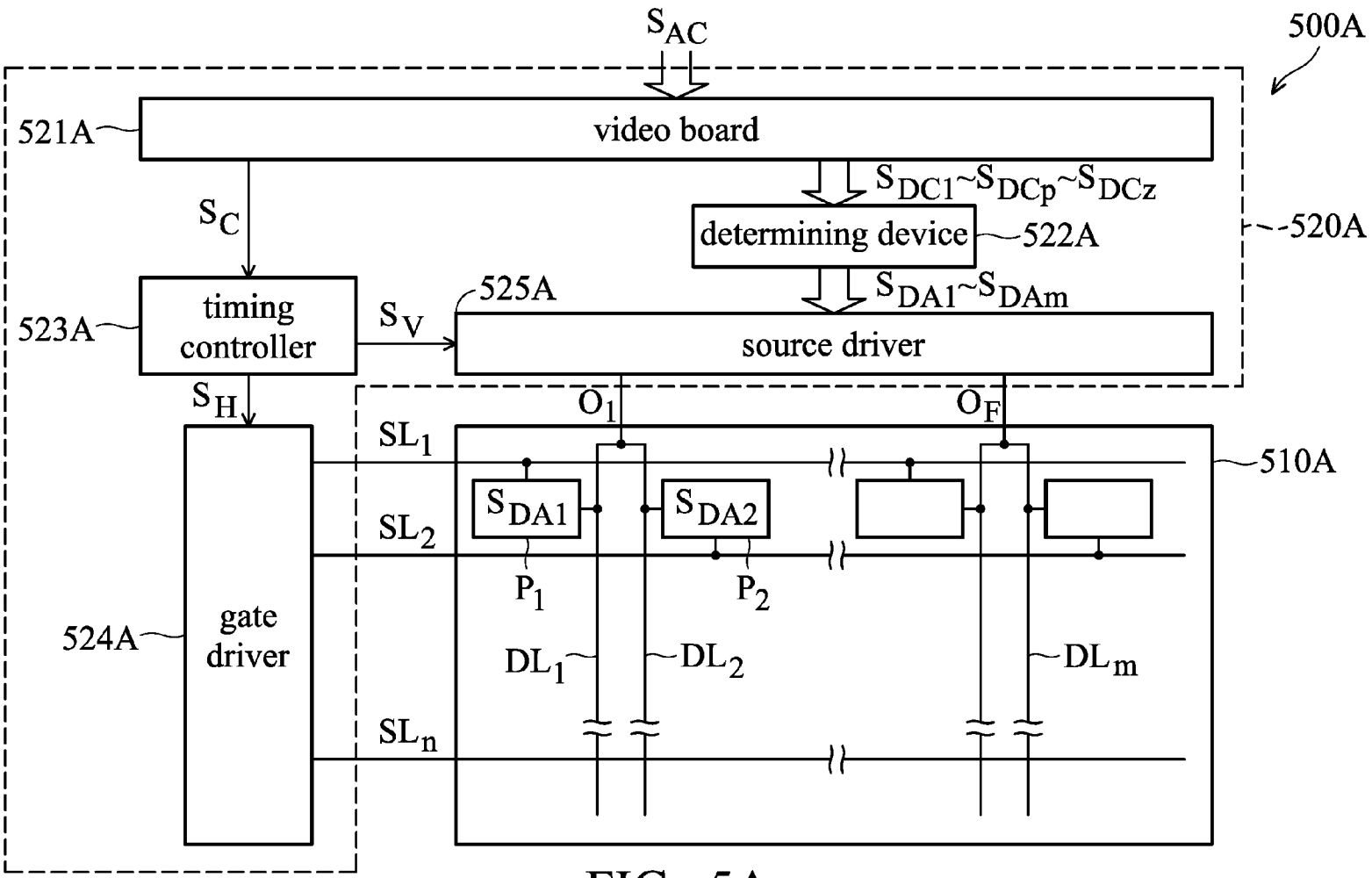
FIGS. 5A and 5B are schematic diagrams of exemplary embodiments of the display device, according to various aspects of the present disclosure.
Figure 5B:
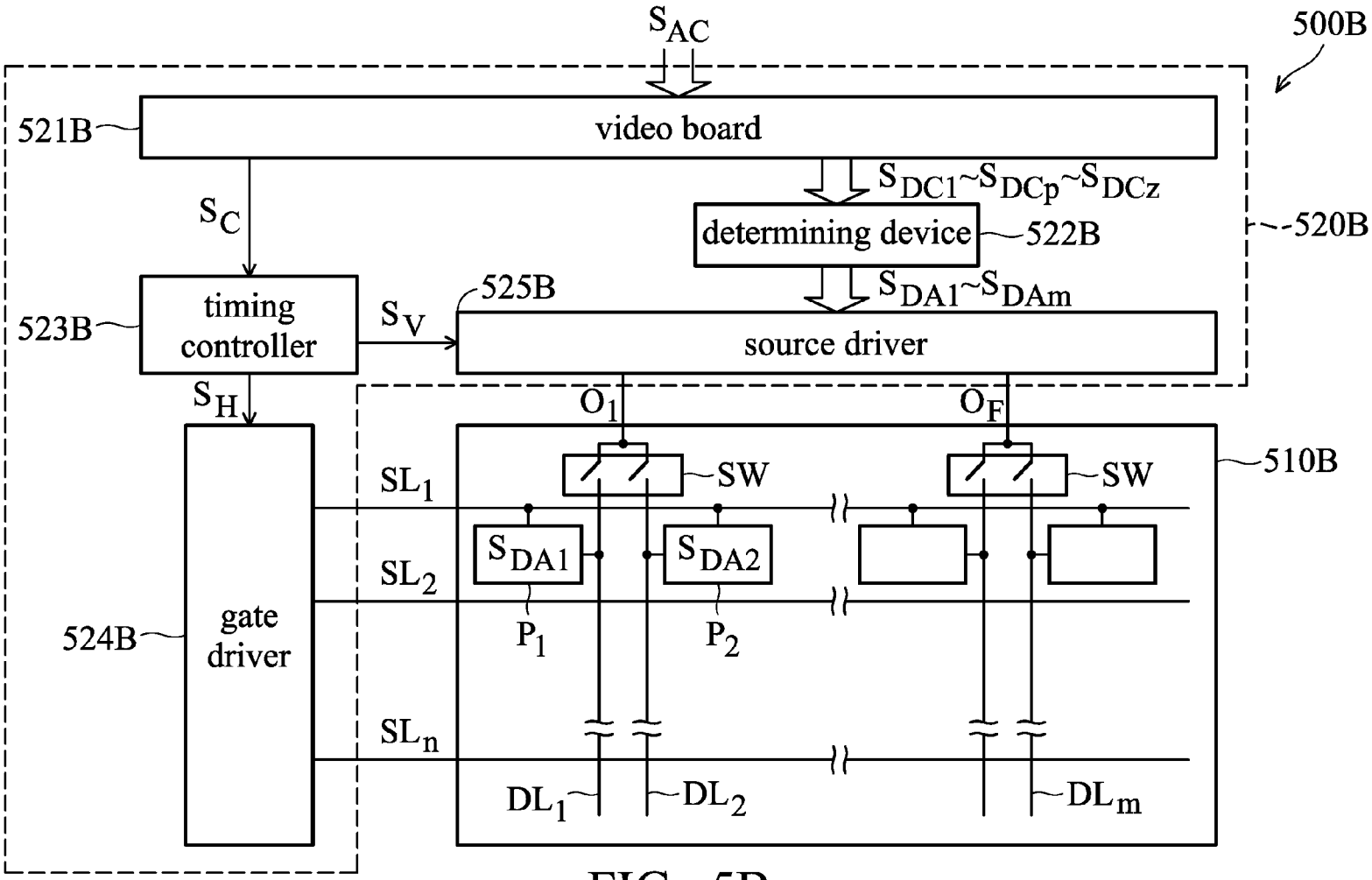

FIGS. 5A and 5B are schematic diagrams of other exemplary embodiments of the display device, according to various aspects of the present disclosure. FIG. 5A is similar to FIG. 1 with the exception that the output terminal of the source driver 525A is coupled to two data lines. For example, the output terminal $O_1$ is coupled to the data lines $DL_1$ and $DL_2$. In this case, the pixel $P_1$ is coupled to the data line $DL_1$, and the pixel $P_2$ is coupled to the data line $DL_2$. Additionally, the pixel $P_1$ is coupled to the scan line $SL_1$, and the pixel $P_2$ is coupled to the scan line $SL_2$.

In FIG. 5B, the output terminal of the source driver 525B is also coupled to two data lines. However, in FIG. 5B, the pixels $P_1$ and $P_2$ are coupled to the same scan line, such as $SL_1$. In this case, the display panel 510B comprises a plurality of switches SW to transmit output image signals to the specific data lines. The switches SW may be controlled by an external device (not shown).

Figure 6A:
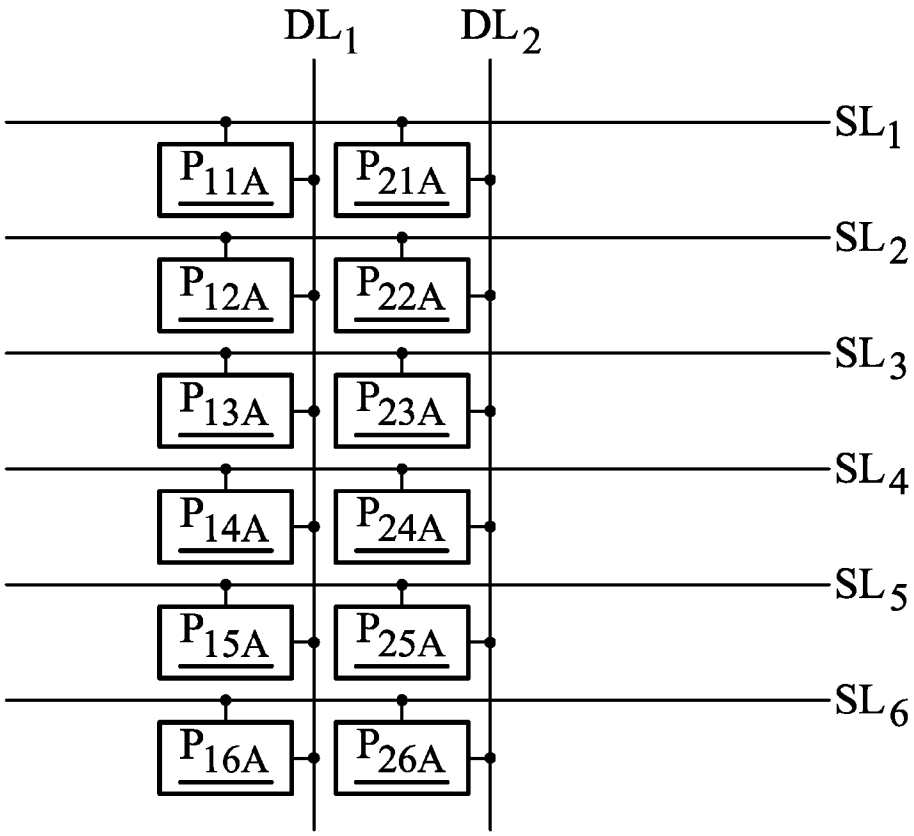
FIGS. 6A~6D are arrangement schematic diagrams of exemplary embodiments of the pixels, according to various aspects of the present disclosure.

FIGS. 6A~6D are schematic diagrams of other exemplary embodiments of the arrangement of the pixels, according to various aspects of the present disclosure. For brevity, FIGS. 6A~6D only show twelve pixels, but the disclosure is not limited thereto. In FIG. 6A, the pixels $P_{11A}$~$P_{16A}$ are coupled to the data line $DL_1$ and coupled to different scan lines. Similarly, the pixels $P_{21A}$~$P_{26A}$ are coupled to the data line $DL_2$ and coupled to different scan lines. Additionally, the pixels $P_{11A}$~$P_{16A}$ are disposed on the left side of the data line $DL_1$, and the pixels $P_{21A}$~$P_{26A}$ are disposed on the left side of the data line $DL_2$. In this embodiment, the pixels $P_{11A}$ and $P_{21A}$ are coupled to the same scan line, such as $SL_1$. The pixels $P_{12A}$ and $P_{22A}$ are coupled to another scan line, such as $SL_2$.

Figure 6B:
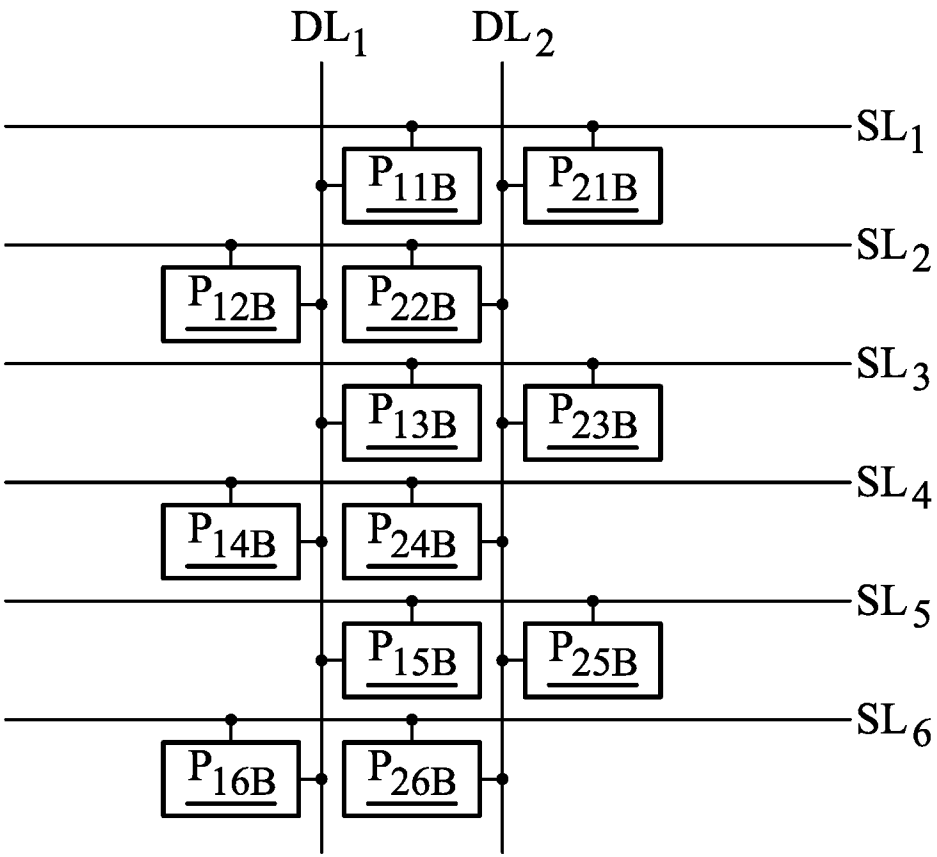
Figure 6C:
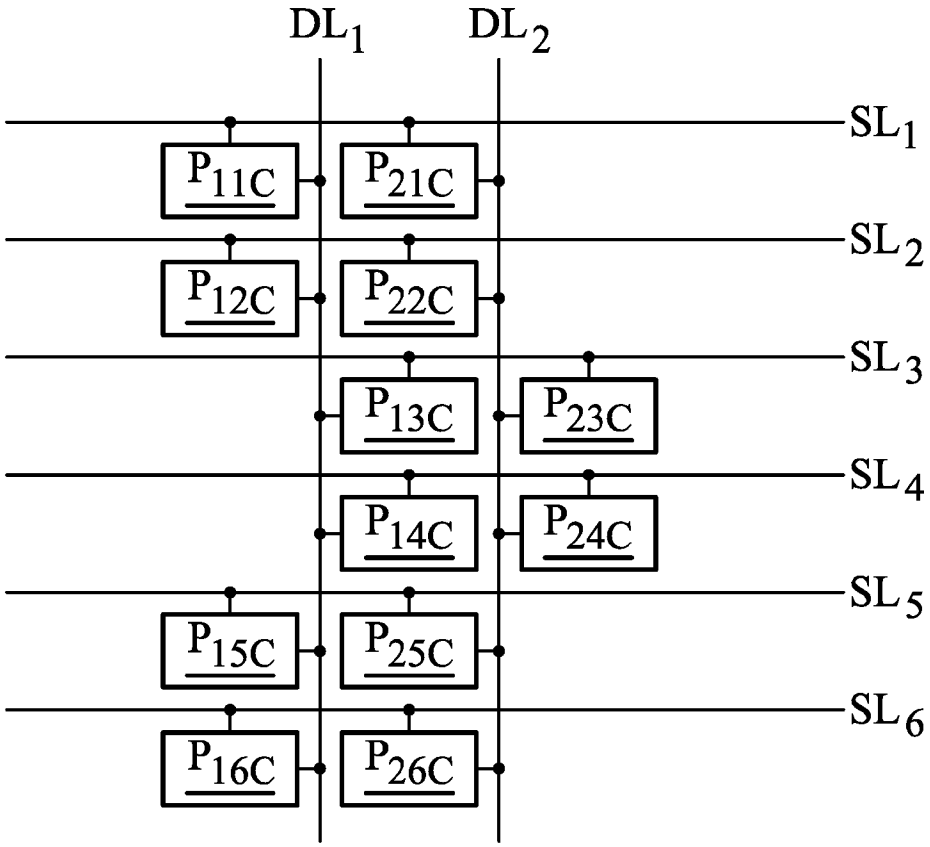

In FIG. 6B, the pixels $P_{11B}$~$P_{16B}$ are coupled to the data line $DL_1$ and coupled to difference scan lines. Similarly, the pixels $P_{21B}$~$P_{26B}$ are coupled to the data line $DL_2$ and coupled to difference scan lines. In this embodiment, the pixels $P_{11B}$, $P_{13B}$, and $P_{15B}$ are disposed on the right side of the data line $DL_1$, and the pixels $P_{12B}$, $P_{14B}$, and $P_{16B}$ are disposed on the left side of the data line $DL_1$. Furthermore, the pixels $P_{21B}$, $P_{23B}$, and $P_{25B}$ are disposed on the right side of the data line $DL_2$, and the pixels $P_{22B}$, $P_{24B}$, and $P_{26B}$ are disposed on the left side of the data line $DL_2$. As shown in FIG. 6B, the pixels $P_{11B}$ and $P_{21B}$ are coupled to the same scan line, such as $SL_1$, and the pixels $P_{12B}$ and $P_{22B}$ are coupled to another scan line, such as $SL_2$.

In FIG. 6B, the pixels $P_{11C}$~$P_{16C}$ are coupled to the data line $DL_1$ and coupled to different scan lines. Similarly, the pixels $P_{21C}$~$P_{26C}$ are coupled to the data line $DL_2$ and coupled to different scan lines. The pixels $P_{11C}$, $P_{12C}$, $P_{15C}$ and $P_{16C}$ are disposed on the left side of the data line $DL_1$. The pixels $P_{13C}$ and $P_{14C}$ are disposed on the right side of the data line $DL_1$. In addition, the pixels $P_{21C}$, $P_{22C}$, $P_{25C}$ and $P_{26C}$ are disposed on the left side of the data line $DL_2$. The pixels $P_{23C}$ and $P_{24C}$ are disposed on the right side of the data line $DL_2$. The pixels $P_{11C}$ and $P_{21C}$ are coupled to the same scan line, such as $SL_1$. The pixels $P_{12C}$ and $P_{22C}$ are coupled to another scan line, such as $SL_2$.

Figure 6D:
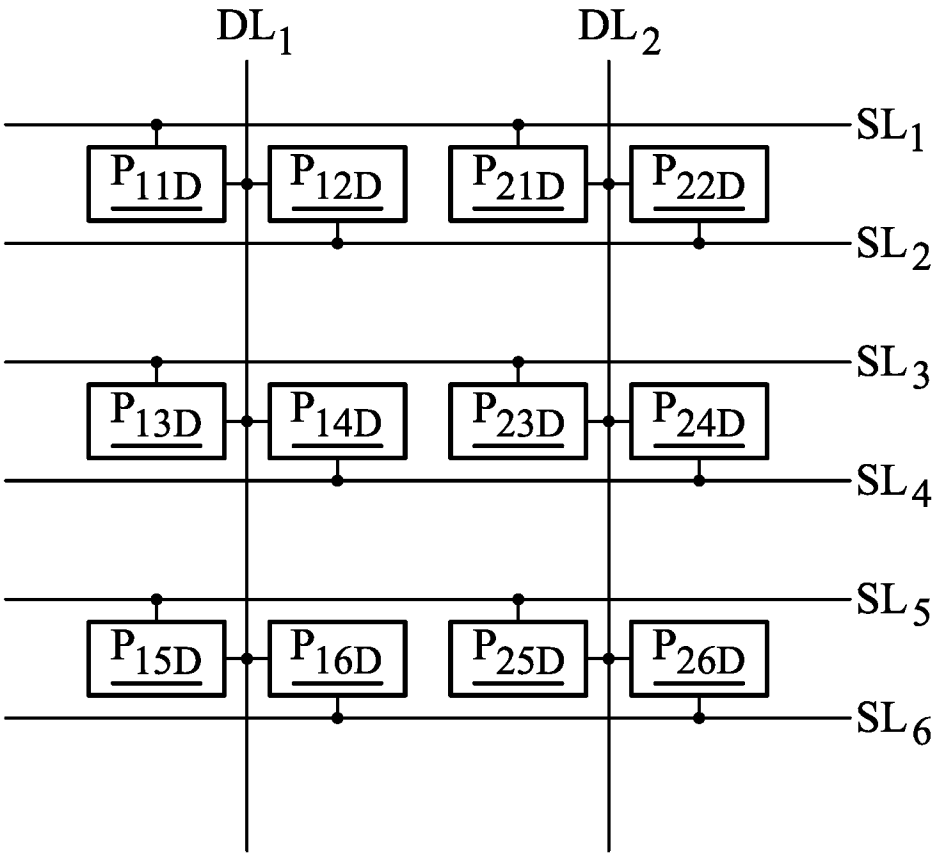

In FIG. 6D, the pixels $P_{11D}$~$P_{16D}$ are coupled to the data line $DL_1$ and coupled to different scan lines. Similarly, the pixels $P_{21D}$~$P_{26D}$ are coupled to the data line $DL_2$ and coupled to different scan lines. The pixels $P_{11D}$, $P_{13D}$ and $P_{15D}$ are disposed on the left side of the data line $DL_1$. The pixels $P_{12D}$, $P_{14D}$ and $P_{16D}$ are disposed on the right side of the data line $DL_1$. Similarly, the pixels $P_{21D}$, $P_{23D}$ and $P_{25D}$ are disposed on the left side of the data line $DL_2$. The pixels $P_{22D}$, $P_{24D}$ and $P_{26D}$ are disposed on the right side of the data line $DL_2$. The pixels $P_{11D}$ and $P_{21D}$ are coupled to the same scan line, such as $SL_1$. The pixels $P_{12D}$ and $P_{22D}$ are coupled to another scan line, such as $SL_2$. Additionally, the pixels $P_{11D}$, $P_{12D}$, $P_{21D}$ and $P_{22D}$ are disposed between the scan lines $SL_1$ and $SL_2$.

In the same frame time, the gray level of each pixel relates to the gray level of the previous pixel. Therefore, the color shift effect and the bright-dark streak effect caused by data distortion caused by the long data lines can be compensated for, to improve the quality of the display panel. In one embodiment, even if the original image signal for a column of the pixels arranged along vertical direction is set to a fixed value, such as the gray level 64, the gray level actually received by the column of the pixels is different from the original image signal.

Taking FIG. 6B as an example, assume that the original gray levels for the pixels $P_{11B}$, $P_{13B}$, and $P_{15B}$ are 64, and the original gray levels for the pixels $P_{12B}$, $P_{14B}$, and $P_{16B}$ are 128. Since the original gray levels of the pixels $P_{12B}$, $P_{14B}$, and $P_{16B}$ are higher than the original gray levels of the pixels $P_{11B}$, $P_{13B}$, and $P_{15B}$, the original gray levels of the pixels $P_{11B}$, $P_{13B}$, and $P_{15B}$ are decreased, such as from 64 to 54. The decreased gray levels are provided to the pixels $P_{11B}$, $P_{13B}$, and $P_{15B}$.

Figure 7:
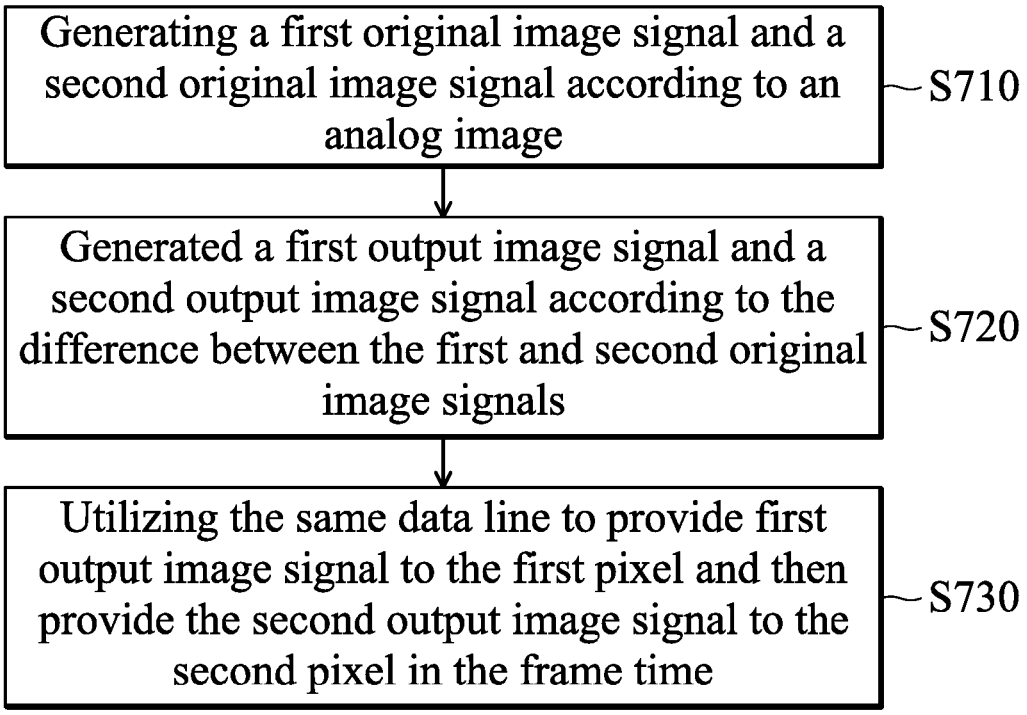
FIG. 7 is a flowchart schematic diagram of exemplary embodiments of a control method, according to various aspects of the present disclosure.

FIG. 7 is a flowchart schematic diagram of an exemplary embodiment of a control method, according to various aspects of the present disclosure. The control method is applied to a display panel. The display panel comprises a data line, a first pixel, and a second pixel. In one embodiment, the first and second pixels are coupled to the same data line. The invention does not limit the arrangement of the first and second pixels. In one embodiment, the connection between the first and second pixels and the data line are shown in FIGS. 1, 5A~5B, and 6A~6D. In other embodiments, the display panel further comprises a plurality of scan lines extended along a horizontal direction.

First, a first original image signal and a second original image signal are generated according to an analog image (step S710). In this embodiment, the first and second original image signals are the data signals for the first and second pixels in a frame time. In one embodiment, the first and second original image signals are gray levels. In the frame time, each scan line in the display panel is asserted one time.

A first output image signal and a second output image signal are generated according to the difference between the first and second original image signals (step S720). The invention does not limit how step S720 generates two output image signals according to the difference between two original image signals. In one embodiment, when the first original image signal is higher than the second original image signal, to subtract a first value from the second original image signal to generate the second output image signal. However, when the first original image signal is less than the second original image signal, to add a second value to the second original image signal to generate the second output image signal.

The invention does not limit the first and second values. In one embodiment, when the differences between the first pixel and the second pixel in the two situations are different, the first and second values are different, too. In other embodiments, the first value is equal to the second value. In another embodiment, when the two differences are within the same pre-determined range, such as gray levels 50~80, the first value is equal to the second value.

In other embodiments, when the difference between the first and second original image signals is higher than a pre-determined value, the first and second original image signals are adjusted and the adjusted results are served as the first and second output image signals. However, when the difference between the first and second original image signals is not higher than the pre-determined value, the first and second original image signals do not be adjusted and the first and second original image signals are served as the first and second output image signals.

In the frame time, the same data line is utilized to output the first output image signal to the first pixel and then output the second output image signal to the second pixel (step S730). In one embodiment, the first pixel displays a first color according to the first output image signal. The second pixel displays a second color according to the second output image signal. The first color may be the same as or different from the second color. In another embodiment, the time when the first pixel receives the first output image signal is earlier than the time when the second pixel receives the second output image signal.

In some embodiments, step S720 further generates a third output image signal and a fourth output image signal according to the difference between a third original image signal and a fourth original image signal. In this case, step S730 utilizes the same data line to provide the third output image signal to a third pixel and then provides the fourth output image signal to a fourth pixel in the frame time. In this embodiment, the first to fourth pixels are coupled to the same data line. In one embodiment, step S730 sequentially provides the first and second output image signals to the first and second pixels in a first period of the frame time and provides the third and fourth output image signals to the third and fourth pixels in a second period of the frame time. In this embodiment, the first period is before the second period.

Since the generation method for the third and fourth output image signals is the same as the generation method for the first and second output image signals, the description of the generation method for the third and fourth output image signals is omitted. In one embodiment, even if the difference between the third and fourth original image signals is the same as the difference between the first and second original image signals, the adjustment range for the third and fourth output image signals is different from the adjustment range for the first and second output image signals.

For example, if the distance between the third and fourth pixels and an external control unit configured to provide output image signals is longer than the distance between the first and second pixels and the external control unit, the adjustment range for the third and fourth original image signals for the third and fourth pixels is larger than the adjustment range for the first and second original image signals for the first and second pixels. In one embodiment, the second original image signal is equal to the fourth original image signal. Since the image signal received by each pixel relates to the image signal received by the previous pixel, the color shift effect and the bright-dark streak effect caused by the equivalent impedances of the data lines.

Unless otherwise defined, all terms (including technical and scientific terms) used herein have the same meaning as commonly understood by one of ordinary skill in the art to which this invention belongs. It should be understood that terms such as those defined in commonly used dictionaries should be interpreted as having a meaning that is consistent with their meaning in the context of the relevant art and will not be interpreted in an idealized or overly formal sense unless expressly so defined herein.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a first pixel;

a second pixel, wherein the first and second pixels are coupled to a data line; and a control unit generating a first original image signal and a second original image signal required by the first and second pixels in a frame time according to an analog image and generating a first output image signal and a second output image signal according to a difference between the first and second original image signals, wherein in the frame time, the control unit sequentially provides the first and second output image signals to the first and second pixels via the data line, wherein the control unit comprises:

a video board comprising a first input receiving an analog image and a first output outputting the first and second original image signals;

a determining device comprising a second input receiving the first and second original image signals and a second output outputting the first and second output image signals;

a timing controller generating a horizontal synchronization signal and a vertical synchronization signal;

a gate driver generating a plurality of scan signals according to the horizontal synchronization signal; and a source driver outputting the first and second output image signals according to the vertical synchronization signal, wherein when the difference between the first and second original image signals is higher than a pre-determined value, the control unit adjusts the first or second original image signal and generates the first and second output image signals, and when the difference between the first and second original image signals is not higher than the pre-determined value, the control unit does not adjust the first and second original image signals, and the first and second original image signals are the same as the first and second output image signal respectively.

2. The display device as claimed in claim 1, wherein the control unit outputs the first output image signal to the first pixel and then outputs the second output image signal to the second pixel.

3. The display device as claimed in claim 1, wherein the first pixel is disposed on a first side of the data line, the second pixel is disposed on a second side of the data line, and the first side is opposite to the second side.

4. The display device as claimed in claim 3, wherein the display device further comprises a plurality of pixels, the data line is coupled to a first group of the pixels and a second group of pixels, the first group is disposed on the first side, and the second group is disposed on the second side.

5. The display device as claimed in claim 1, wherein the first pixel is disposed on a first side of the data line, the second pixel is disposed on a second side of the data line, and the first side is opposite to the second side, wherein the first pixel is coupled to a first scan line, the second pixel is coupled to a second scan line which is neighboring the first scan line, and the first and second pixels are disposed between the first and second scan lines.

6. The display device as claimed in claim 1, wherein the control unit generates a third output image signal and a fourth output image signal according to a difference between a third original image signal and a fourth original image signal, and the control unit sequentially outputs the third output image signal to a third pixel and outputs the fourth output image signal to a fourth pixel via the data line, wherein when the third original image signal is the same as the first original image signal and the fourth original image signal is the same as the second original image signal, the fourth output image signal is different from the second output image signal.

7. A control method applied in a display panel comprising a data line, a first pixel, and a second pixel, wherein the first and second pixels are coupled to the data line, comprising:

generating a first original image signal and a second original image signal required by the first and second pixels in a frame time according to an analog image;

generating a first output image signal and a second output image signal according to a difference between the first and second original image signals; and sequentially providing the first output image signal to the first pixel and providing the second output image signal to the second pixel via the data line in the frame time, wherein the step of generating the first and second output image signals according to the difference between the first and second original image signals comprises:

judging the difference between the first and second original image signals, wherein when the difference between the first and second original image signals is higher than a pre-determined value, the first or second original image signal is adjusted to generate the first and second output image signals, and when the difference between the first and second original image signals is not higher than the pre-determined value, the first and second original image signals are the same as the first and second output image signals.

8. The control method as claimed in claim 7, further comprising:

generating a third output image signal and a fourth output image signal according to a difference between a third original image signal and a fourth original image signal; and sequentially outputting the third output image signal to a third pixel and outputting the fourth output image signal to a fourth pixel via the data line in the frame time, wherein the data line sequentially provides the first output image signal to the first pixel, provides the second output image signal to the second pixel, provides the third output image signal to the third pixel, and then provides the fourth output image signal to the fourth pixel, and wherein when the third original image signal is the same as the first original image signal and the fourth original image signal is the same as the second original image signal, the fourth output image signal is different from the second output image signal.

* * * * *